United States Patent [19]

Farr

[11] 4,239,215

[45] Dec. 16, 1980

[54] DEVICES FOR PRACTISING BALL-GAME STROKE PLAY

[75] Inventor: Eric Farr, Newburgh, Scotland

[73] Assignee: Tecsports of Oxford Limited, Great Britain

[21] Appl. No.: 14,608

[22] Filed: Feb. 23, 1979

Related U.S. Application Data

[63] Continuation of Ser. No. 773,319, Mar. 1, 1977, abandoned.

[30] Foreign Application Priority Data

Mar. 4, 1976 [GB] United Kingdom ..... 8804/76
Jul. 8, 1976 [GB] United Kingdom ..... 28457/76

[51] Int. Cl.[3] ..... A63B 61/00

[52] U.S. Cl. ..... 273/29 A; 272/77; 273/67 R

[58] Field of Search ..... 273/67 R, 67 D, 95 R, 273/77 A, 73 R, 73 H, 73 J, DIG. 7, DIG. 5, 80 D, 80 R, 29 A, 26 R, 26 A, DIG. 23; 272/76, 77, 78

[56] References Cited

U.S. PATENT DOCUMENTS

| | | | |
|---|---|---|---|
| 1,516,786 | 11/1924 | Prentiss | 273/77 A |
| 1,539,019 | 5/1925 | Nikonow | 273/73 R |
| 1,937,787 | 12/1933 | Robinson | 273/73 H |
| 2,969,984 | 1/1961 | Presnick | 273/73 R |
| 2,992,828 | 7/1961 | Stewart | 273/67 R |
| 3,106,091 | 10/1963 | Karr | 273/77 A |
| 3,239,224 | 3/1966 | Finn et al. | 273/73 R |
| 3,305,235 | 2/1967 | Williams, Jr. | 273/80 D |
| 3,431,626 | 3/1969 | Carlton | 273/73 H |
| 3,473,370 | 10/1969 | Marciniak | 273/73 A |
| 3,483,055 | 12/1969 | Eschbaugh | 273/DIG. 7 |
| 3,515,386 | 6/1970 | Mason | 273/73 R |
| 3,889,951 | 6/1975 | Schaefer | 273/73 F |
| 3,921,978 | 11/1975 | Warren | 273/67 R |
| 4,084,819 | 4/1978 | Auken | 273/80 R |
| 4,093,217 | 6/1978 | Piccini | 273/26 R |

FOREIGN PATENT DOCUMENTS

| | | | |
|---|---|---|---|
| 358586 | 9/1922 | Fed. Rep. of Germany | 273/73 R |
| 648969 | 12/1928 | France | 273/29 A |
| 1915 | of 1915 | United Kingdom | 273/73 R |
| 465414 | 5/1937 | United Kingdom | 273/77 A |
| 712160 | 7/1954 | United Kingdom | 273/73 R |
| 734214 | 5/1955 | United Kingdom | 273/73 R |
| 731382 | 6/1955 | United Kingdom | 273/73 R |
| 1349906 | 4/1974 | United Kingdom | 273/DIG. 23 |

*Primary Examiner*—Richard C. Pinkham
*Assistant Examiner*—T. Brown
*Attorney, Agent, or Firm*—Kane, Dalsimer, Kane, Sullivan and Kurucz

[57] ABSTRACT

This invention concerns devices for practising ball-game stroke play. The device has a handle portion and a head portion, the heat portion being resiliently displaceable transversely relative to the handle portion. The overall length of each device, the weight of the device, and the weight distribution of the device are arranged to be similar to that of a conventional ball-game implement which the device is arranged to simulate so that when the head portion is struck against a solid object or target, the device will reproduce the characteristics and sensation to the user of the implement which it simulates when that implement is used in stroke play.

3 Claims, 12 Drawing Figures

G
2
3
5
6
1
X
4
D 2
3
5
6
E
1
X
4
D
C
B
A

H
H
7
5

F
4
3
2

DEVICES FOR PRACTISING BALL-GAME STROKE PLAY

This is a continuation of application Ser. No. 773,319, filed Mar. 1, 1977, since abandoned.

This invention relates to devices for practising ball-game stroke play.

The present invention provides a device for simulating and practising ball-game stroke play, the device comprising a handle portion and a head portion; wherein each of the overall length of the device, the weight of the device, and the weight distribution of the device is similar to that of a conventional ball-game implement which the device is arranged to simulate; and wherein the head portion is resiliently displaceable transversely relative to the handle portion.

Throughout this Specification the word "ball" should be construed to embrace any missile used in stroke-play games and it includes, for example, not only a tennis ball, squash ball, cricket ball or golf-ball but also a badminton shuttle-cock.

Devices can be constructed in accordance with the invention to simulate most, if not all stroke-play implements, for example, squash, tennis, or badminton racquets; or cricket or baseball bats or golf clubs; or hockey sticks. In each case the device is held by the handle portion and its head portion is then driven or stroked against an object, for example a fixed object such as a wall or post or, preferably, against a target to be described in detail below. In this way the device will produce for the user a sensation similar to that of striking a ball with the conventional stroke play implement which the device is arranged to simulate.

The device may have only a head and a handle portion. For example, the head portion may be in the form of shaft or blade which is resiliently flexible and is connected directly to the handle portion. Such a device would be particularly suited for practising cricket or baseball stroke play.

However, the device may also include a portion interconnecting the head and handle portions. Such a device is particularly suited for practising squash, tennis, badminton, golf or hockey stroke-play.

When the device has an interconnecting portion there are a number of ways in which the head portion can be arranged to be resiliently displaceable relative to the handle portion. Thus, a part only of the interconnecting portion may be resiliently flexible to allow the head portion to be displaceable relative to the handle portion. For example, that part of the interconnecting portion adjacent the head portion may be resiliently flexible to allow the head portion to be displaceable relative to the handle portion and the remaining part of the interconnecting portion.

However, preferably the whole of the interconnecting portion is resiliently flexible. This can not only simplify the construction of the device but can also provide it with better operating characteristics. The latter are also improved if the head portion itself is resiliently flexible.

The invention further provides a device for practising squash stroke play, the device comprising a handle portion and a head portion, and the device having the following characteristics (a) the weight of the device is about 210 gms to about 400 gms, (b) the overall length of the device is about 60 cms to about 70 cms, (c) the diameter of the handle portion is about 2 cms to about 4 cms, (d) the moment of inertia of the device about an axis transverse to, and passing mid-way through the handle portion is about 214 gms (weight) cm.sec$^2$ to about 306 gms (weight) cm.sec$^2$ and (e) the head portion is resiliently displaceable transversely relative to the handle portion.

The invention further provides a device for practising tennis stroke play, the device comprising a handle portion and a head portion, and the device having the following characteristics (a) the weight of the device is about 300 gms to about 450 gms, (b) the overall length of the device is about 60 cms to about 70 cms, (c) the diameter of the handle portion is about 2 cms to about 4 cms, (d) the moment of inertia of the device about an axis transverse to, and passing mid-way through the handle portion is about 265 gms$_2$(weight) cm.sec$^2$ to about 357 gms (weight) cm.sec$^2$ and (e) the head portion is resiliently displaceable transversely relative to the handle portion.

The invention further provides a device for practising badminton stroke-play, the device comprising a handle portion and a head portion and the device having the following characteristics:

(a) the weight of the device is about 110 gms to about 200 gms, (b) the overall length of the device is about 60 cms to about 70 cms, (c) the diameter of the handle portion is about 2 cms to about 4 cms, (d) the moment of inertia of the device about an axis transverse to, and passing mid-way through the handle portion is about 98 gms (weight) cm.sec$^2$to about 138 gms (weight) cm.sec$^2$ and (e) the head portion is resiliently displaceable transversely relative to the handle portion.

With these ranges of parameters each device will reproduce when the head portion is struck against a solid object or target, the characteristics and sensation to the user of the implement which it simulates (that is to say, a squash, tennis or badminton racquet) when that implement is used in stroke-play. In particular, the range of moments of inertia of the device will reproduce for the user the feel, and weight distribution of its conventional counterpart.

Advantageously each device includes a portion, which is preferably resiliently flexible, interconnecting the head and handle portions.

Further, it is of advantage if each device has a resiliently flexible head portion.

Preferably, the overall length of the squash device is about 61 cms to about 67 cms.

Preferably, the overall length of the tennis device is about 61 cms to about 65 cms.

Preferably, the overall length of the badminton device is about 60 cms to about 64 cms.

The feel, and weight distribution will be improved if the radius of gyration of the device about the said axis is about 25 cms to about 37 cms. In order to achieve a moment of inertia within the aforesaid ranges of each device one does not take the lowest value of each of the ranges for the weight and radius of gyration of the device together and if, for example, the device has a relatively low (high) weight than its radius of gyration should be relatively high (low).

To improve the balance of each device the centre of gravity, measured from the free end of the handle portion is about 28 cms to about 37 cms, about 24 cms to about 34 cms and about 28 cms to about 36 cms, for the squash, badminton, and tennis device respectively.

The head portion of a device constructed in accordance with the invention may be made from any suitable resilient material. For example, the head portion can be made of an elastomeric material, preferably natural or synthetic rubber, which has the necessary resilience and is sufficiently robust. If necessary, the resilient material can have a strengthening filler of, for example, fibre glass, or carbon.

The head portion is preferably moulded.

The interconnecting portion of a device constructed in accordance with the invention may comprise a resiliently flexible shaft made, for example, from nylon, polypropylene, fibre glass or similar material, the shaft being integrally secured to the head and handle portions.

Preferably the shaft extends at least partially into the head portion and at least partially into the handle portion. In this way the handle and head portions are suitably strengthened. If necessary the shaft material may be reinforced by, or replaced by stronger material, for example steel wire, in those regions where it extends into the handle and head portions.

Advantageously, the head and handle portions are formed from the same material and, preferably, the head and handle portions are formed in a single moulding process.

The shaft may be encased in a resilient material, the head portion and the encasement being made from the same material, and preferably, being formed in the same mould. The encasement is particularly valuable for guarding against the head portion breaking free of the interconnecting portion and for guarding against damage or destruction of the device if, for example, when it is aimed against a solid object, the interconnecting portion and not the head portion strikes the object.

In this case, it is expedient, also, to form the handle portion from the same material as that forming the head portion and the encasement, the handle portion also being formed in the said mould.

Depending upon the application of the device, the head portion can have various shapes and sizes. For example, it can be rectangular, triangular, circular or elliptical in form; or it can be annular or toroidal in form; or it can be spherical or spheroidal in form.

The present invention further provides apparatus for simulating and practising ball-game stroke play, the apparatus comprising a device constructed in accordance with the invention and a target against which the device can be driven or stroked.

Although the device can be driven or stroked against an object such as a wall or post it is of advantage if a properly constructed and weighted target is provided for this purpose.

The target may be free-standing or may be suspensible and is preferably provided with a marking(s) to indicate the region of the target which should be struck.

Advantageously, the free-standing target has a flat base and tapers upwardly from the base. For example, the target may be frusto-conical in form.

Advantageously, the suspensible target is of bag-like form and is provided with means for receiving a rope or other suspension means.

Preferably, the target is a hollow flexible member having an opening through which a suitable material, for example, sand or soil may be passed to weight the target.

Advantageously the hollow flexible member is made from nylon, P.V.C., leather, rubber or any other suitably robust material.

Preferably, the weight, when filled, of the free-standing target is between about 6 kgms to 15 kgms; and the suspensible target between 0.5 kgms to 5.0 kgms.

Various devices for practising ball-game stroke play and constructed in accordance with the invention will now be described by way of example only, with reference to the accompanying drawings in which.

Figures 1, 2, 3, 4:
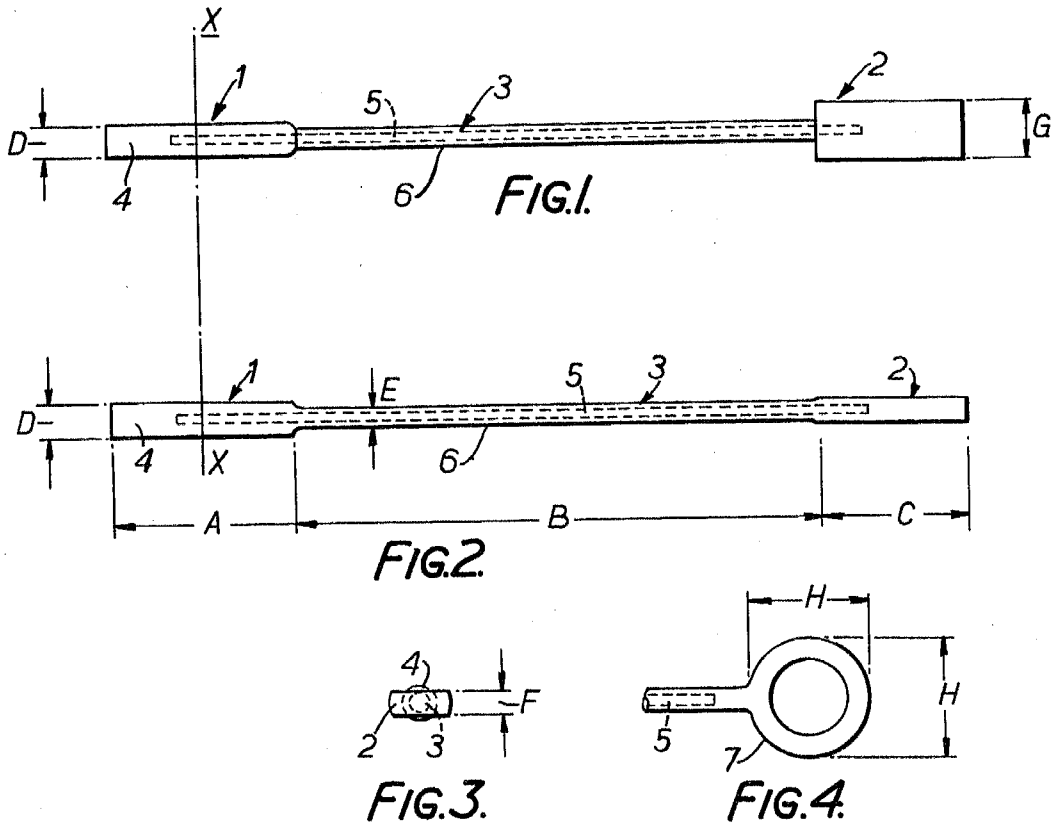
FIG. 1 is a plan view of one device.
FIG. 2 is a side view of the device shown in FIG. 1.
FIG. 3 is an end view of the device shown in FIGS. 1 and 2.
FIG. 4 illustrates a modification of part of the device shown in FIGS. 1 to 3.
Figure 5:
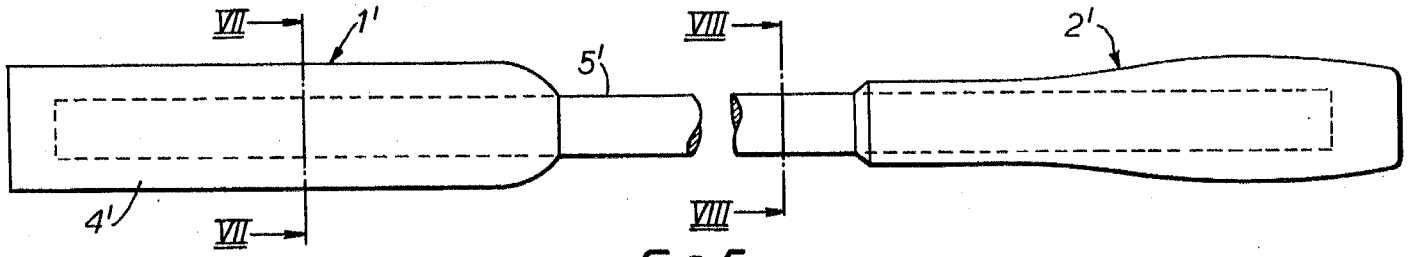
FIG. 5 is a side view of another device.
Figure 6:
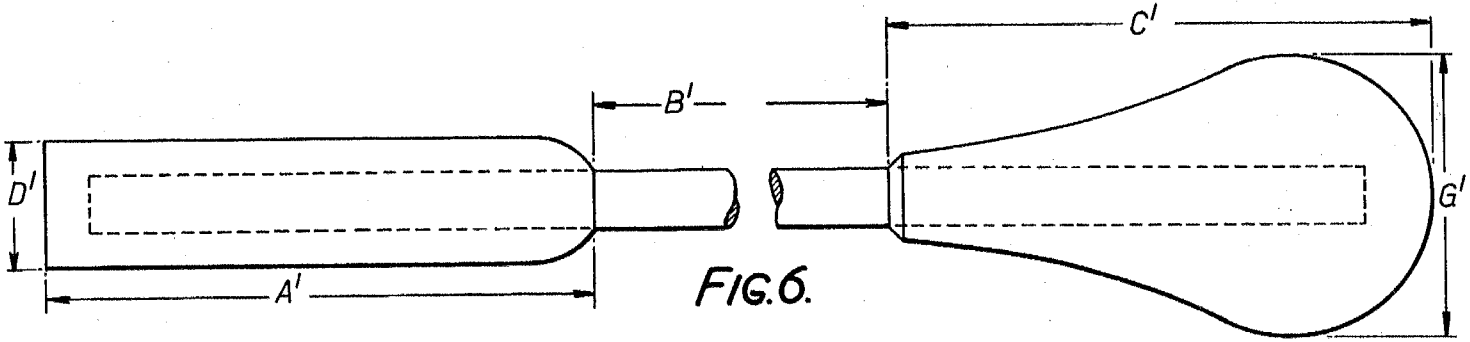
FIG. 6 is a plan view of the device shown in FIG. 5.
Figure 8:
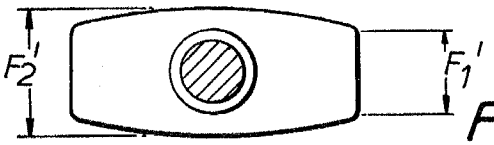
FIG. 8 is a section on the line B—B of FIG. 5.
Figure 7:
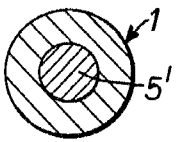
FIG. 7 is a section on the line A—A in FIG. 5.

Referring to the accompanying drawings, FIGS. 1 to 3 illustrate the general form of a device which can be used for practising squash, tennis, or badminton stroke-play.

The device comprises a cylindrical handle portion 1, a flat head portion 2 which is rectangular in form, and a cylindrical interconnecting portion 3 between the head and handle portions.

The head portion 2 is made of any suitable resilient material. Thus, the head portion 2 can be rubber, for example, pure gum vulcanised latex which can have a strengthening filler of, for example, carbon.

The handle portion has a cylindrical gripping portion 4 made from the same material as the head portion 2.

The interconnecting portion 3 comprises a cylindrical shaft 5 of semi-rigid material, for example nylon or polypropylene, fibre glass which has an encasement 6 made from the same material as the head portion 2.

One end portion of the shaft 5 extends partially into the head portion 2 and its other end portion extends partially into the gripping portion 4.

The device is made by placing the shaft 5 in a mould and injecting moulding material integrally to form the gripping portion 4, the encasement 6, and the head portion 2.

FIG. 4 illustrates an alternative head portion 7. The latter is in the form of flat ring 8 and is formed from the same material as the head portion 2.

The device is so constructed that it retains it shape and is sufficiently flexible, especially in the region of the head portion 2, that when held by the handle portion 1 and driven or stroked against a fixed object, for example a wall or post, or against a target to be described in detail below, it will produce for the user a sensation similar to that of striking a ball with the conventional stroke-play implement which the device is simulating.

The device described hereinbefore with reference to the accompanying drawings can be modified in a number of respects. Thus, for example, the head portion 2 need not be made of, or entirely of, resiliently flexible material, and, for example, only the interconnecting portion itself or only that part of the interconnecting portion adjacent the head portion may be made of such material. Thus, it is only essential for the head portion 2 to be resiliently displaceable relative to the interconnecting portion 3 and/or the handle portion. However, it is preferred, from the viewpoint of relative simplicity of construction and also from the viewpoint of better operating characteristics, to have the head portion and the interconnecting portion formed from resiliently flexible material.

The shape and size of the head portion may be varied according to the application of the device.

The material forming the shaft 5 may be reinforced by, or replaced by, stronger material, for example steel wire, in those regions where it extends into the handle and/or head portions.

Further, the gripping portion 4 and/or the encasement 6 may be made from a material different from that of the head portion 2, and the materials forming the gripping portion and the encasement may be different.

As an example of suitable dimensions for a squash device constructed generally as shown in FIGS. 1 to 4 of the accompanying drawings:

(a) The overall length of the device is about 60 cms to about 70 cms and is preferably about 61 cms to about 67 cms, (b) The length of the handle portion, A is about 10 cms to about 18 cms, (c) The length, B of the interconnecting portion is about 30 cms to about 50 cms, (d) The length, C of the head portion of FIGS. 1 to 3 is about 5 cms to about 15 cms, (e) The length of the shaft 5 is about 40 cms to about 65 cms, (f) The diameter, D of the handle portion is about 2 cms to about 4 cms, (g) The diameter, E of the interconnecting portion is about 1.2 cms to about 1.8 cms, (h) The diameter of the shaft 5 is about 1 cm to about 1.6 cms, (i) The thickness F of the head portion of FIGS. 1 to 3 is about 1.5 cms to about 3.0 cms, (j) The width, G of the head portion of FIGS. 1 to 3 is about 3 cms to about 15 cms, (k) The diameter H of the head portion shown in FIG. 4 is about 5 cms to about 10 cms, (l) The thickness of the head portion shown in FIG. 4 is about 1.5 cms to about 3.0 cms, (m) The weight of the device is about 210 gms to about 400 gms, (n) The moment of inertia of the device about an axis X—X passing midway through the handle portion is about 214 gms (weight) cm.sec$^2$ to about 306 (weight) cm.sec$^2$, (o) The radius of gyration of the device about the axis X—X is about 25 cms to about 37 cms, and (p) The centre of gravity of the device, measured from the free end of the handle portion, is about 28 cms to about 37 cms.

As an example of suitable dimensions for a tennis device constructed generally as shown in FIGS. 1 to 4 of the accompanying drawings:

(a) The overall length of the device is about 60 cms to about 70 cms and is preferably about 61 cms to about 65 cms.

(b) The length of the handle portion, A is about 10 cms to about 21 cms, (c) The length, B of the interconnecting portion is about 30 cms to about 50 cms, (d) The length, C of the head portion of FIGS. 1 to 3 is about 5 cms to about 20 cms, (e) The length of the shaft 5 is about 40 cms to about 68 cms, (f) The diameter, D of the handle portion is about 2 cms to about 4 cms, (g) The diameter, E of the interconnecting portion is about 1.2 cms to about 2.0 cms, (h) The diameter of the shaft 5 is about 1 cm to about 1.8 cms, (i) The thickness, F of the head portion of FIGS. 1 to 3 is about 1.5 cms to about 3.5 cms, (j) The width, G of the head portion of FIGS. 1 to 3 is about 4 cms to about 20 cms, (k) The diameter, H of the head portion shown in FIG. 4 is about 5 cms to about 20 cms, (l) The thickness of the head portion shown in FIG. 4 is about 1.5 cms to about 3.5 cms, (m) The weight of the device is about 300 gms to about 450 gms, (n) The moment of inertia of the device about an axis X—X passing midway through the handle portion is about 265 gms (weight) cm.sec$^2$ to about 357 gms (weight) cm.sec$^2$.

(o) The radius of gyration of the device about the axis X—X is about 25 cms to about 37 cms, and (p) The centre of gravity of the device, measured from the free end of the handle portion is about 28 cms to about 36 cms.

As an example of suitable dimensions for a badminton device constructed generally as shown in FIGS. 1 to 4 of the accompanying drawings:

(a) The overall length of the device is about 60 cms to about 70 cms and is preferably about 62 cms to about 64 cms, (b) The length of the handle portion, A is about 10 cms to about 19 cms, (c) The length, B of the interconnecting portion is about 30 cms to about 50 cms, (d) The length, C of the head portion of FIGS. 1 to 3 is about 5 cms to about 20 cms, (e) The length of the shaft 5 is about 40 cms to about 60 cms, (f) The diameter, D of the handle portion is about 2 cms to about 4 cms, (g) The diameter E of the interconnecting portion is about 1.0 cms to about 1.8 cms, (h) The diameter of the shaft 5 is about 0.8 cm to about 1.6 cms, (i) The thickness, F of the head portion of FIGS. 1 to 3 is about 1.5 cms to about 2.5 cms, (j) The width, G of the head portion of FIGS. 1 to 3 is about 5 cms to about 10 cms, (k) The diameter H, of the head portion shown in FIG. 4 is about 5 cms to about 10 cms, (l) The thickness of the head portion shown in FIG. 4 is about 1.5 cms to about 2.5 cms, (m) the weight of the device is about 110 gms to about 200 gms, (n) The moment of inertia of the device about an axis X—X passing midway through the handle portion is about 98 gms (weight) cm.sec$^2$ to about 138 gms (weight) cm.sec$^2$, (o) The radius of gyration of the device about the axis X—X is about 25 cms to about 37 cms, and (p) The centre of gravity of the device, measured from the free end of the handle portion 1 is about 24 cms to about 34 cms.

FIGS. 5 to 9 illustrate another form of device which is especially suitable for practising squash stroke-play.

The device shown in FIGS. 5 to 9 is essentially the same as that described above and illustrated in FIGS. 1 to 4, and accordingly similar parts have been identified by corresponding primed reference characters. The main differences are the shape of the head portion 2' and handle portion 1' and, further, no encasement is provided for the shaft 5'.

The materials forming the head, handle and interconnecting portions are the same as those described above in connection with the devices shown in FIGS. 1 to 4. Further, the head portion 2' and the handle portion 1' are formed in a single moulding process.

Figure 9:
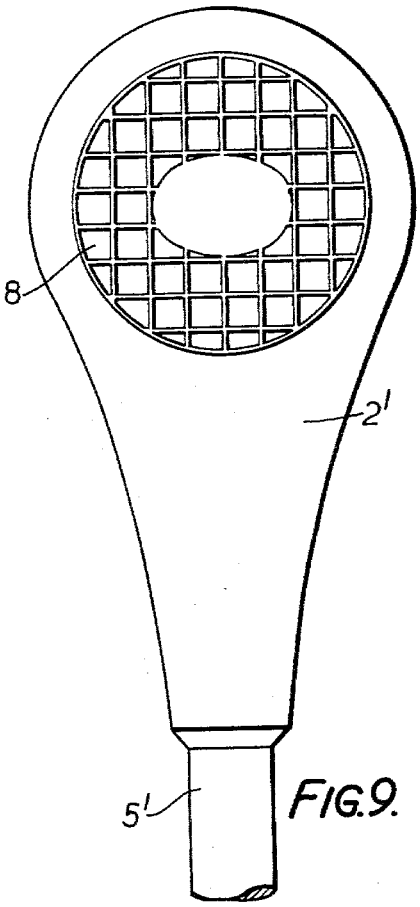
FIG. 9 is a detail showing one side of the head portion of the device illustrated in FIG. 5.

As will be seen in FIG. 9 one side (the striking side) of the head is formed with a raised rib lattice-like formation 8 which is struck against an object or target when the device is in use. The ribs are raised by 1mm above the general surface level.

As an example of suitable dimensions of the device shown in FIGS. 5 to 9 of the accompanying drawings:

(a) The overall length of the device is about 61.75 cms.

(b) The overall length A', of the handle portion is about 12.5 cms.

(c) The length B' of the interconnecting portion is about 36.75 cms.

(d) The length C' of the head portion is about 12.25 cms.

(e) The length of the shaft 5' is about 59 cms.

(f) The diameter D' of the handle portion is about 3 cms.

(g) The diameter of the shaft 5' is about 1.4 cms.

(h) The minimum thickness $F_1'$ of the head portion is about 2 cms and the maximum thickness $F_2'$ about 3 cms.

(i) The maximum width G' of the head portion is about 6.5 cms.

Each of the weight, moment of inertia, radious of gyration and centre of gravity of the device illustrated in FIGS. 5 to 9 falls within the ranges given above in connection with the device shown in FIGS. 1 to 4.

Figure 10:
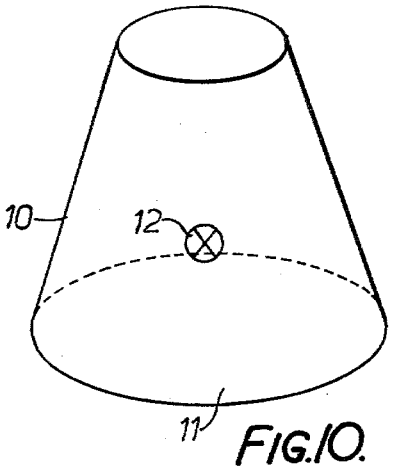
FIG. 10 shows a perspective view of a target.
Figure 11:
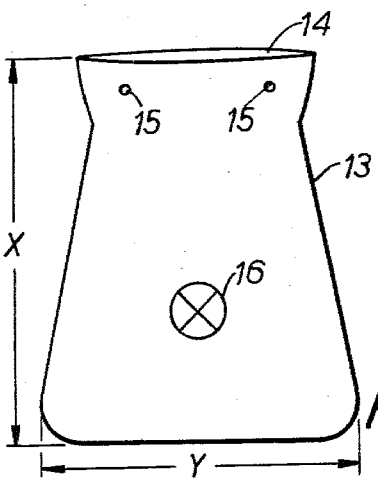
FIG. 11 shows a side view of another target.
Figure 12:
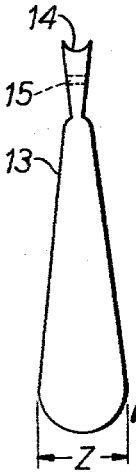
FIG. 12 shows an end view of the target illustrated in FIG. 11.

FIGS. 10 to 12 illustrate, diagrammatically, two forms of a target which can be used with the devices shown in FIGS. 1 to 9.

The target 10, shown in FIG. 10 is a hollow flexible frusto-conical member and has, for example, a height of between about 15 cms to 30 cms, a base diameter of between about 20 cms to 35 cms and an upper diameter of between about 10 cms to 20 cms.

The target is free-standing and is placed with its base 11, on the ground. The target has a re-closable opening (not shown) through which suitable material, for example sand or soil, can be passed to weight the target. When filled the target weighs between, for example, about 10 kgms to 15 kgms.

The target is provided with a marked region 12 which indicates the preferred region of the target for striking by the device of FIGS. 1 to 9.

The target 13 shown in FIGS. 11 and 12 is in the form of a hollow flexible bag having an opening 14 at the top through which suitable material, for example sand or soil, can be passed to weight the target.

When filled the target weighs, for example, between about 1.5 kgms to 5.0 kgms.

The bag 13 has, for example, a height X of between about 25 cms to 45 cms, a width, Y, of between about 15 cms to 25 cms, and a thickness, Z, of between about 5 cms to 25 cms.

The target 13 is provided with holes or eyelets 15 for receiving a rope or other suspension means so that the target can be suspended above the ground. The target is also provided with a marking 16 similar to the marking 12 of the target 10.

The targets shown in FIGS. 10 and 11 are made from nylon, P.V.C., leather, rubber or any other suitably robust material.

What I claim is:

1. Apparatus for simulating and practising ball-game stroke play comprising a device for simulating and practicing ball-game stroke play, the device comprising a handle portion and a head portion; wherein the device has an overall length, a weight, and a weight distribution each of which is similar to that of a conventional ball-game racquet which the device is arranged to simulate; and wherein the head portion comprises a solid mass of resiliently flexible material, the device being such that when held by its handle portion and its head portion is stroked against a weighted target and head portion is resiliently displaced relative to the handle portion producing a sensation, for the user, similar to that of striking a ball with the conventional ball-game raquet; and a target against which the device can be stroked, the target being a hollow flexible member having an opening through which a suitable material may be passed to weight the target.

2. Apparatus as claimed in claim 1, in which the hollow flexible member is made of robust material selected from the group consisting of nylon, P.V.C., leather and rubber.

3. Apparatus as claimed in claim 1, in which the weight, when filled, of the target, is between approximately 6 kgms and 15 kgms.

* * * * *